United States Patent [19]

Etienne et al.

[11] Patent Number: 4,578,655

[45] Date of Patent: Mar. 25, 1986

[54] TUNEABLE ULTRA-HIGH FREQUENCY FILTER WITH MODE TM010 DIELECTRIC RESONATORS

[75] Inventors: Jean-Luc Etienne, Sevres; Jean-Claude Cruchon, Bouffemont, both of France

[73] Assignee: Thomson-CSF, Paris, France

[21] Appl. No.: 569,712

[22] Filed: Jan. 10, 1984

[30] Foreign Application Priority Data

Jan. 19, 1983 [FR] France ..... 83 00755

[51] Int. Cl.[4] ..... H01P 1/20

[52] U.S. Cl. ..... 333/202; 333/219; 333/235; 333/210

[58] Field of Search ..... 333/202, 203, 205, 210, 333/219, 235, 227, 232

[56] References Cited

U.S. PATENT DOCUMENTS

| | | | |
|---|---|---|---|
| 3,639,862 | 2/1972 | Craven et al. | 333/210 |
| 4,028,652 | 6/1977 | Wakino et al. | 333/202 X |
| 4,121,181 | 10/1978 | Nishikawa et al. | 333/205 X |
| 4,459,570 | 7/1984 | Delabelle et al. | 313/219 X |

FOREIGN PATENT DOCUMENTS

| | | |
|---|---|---|
| 1496177 | 9/1967 | France . |
| 1526605 | 8/1969 | France . |
| 2391569 | 5/1978 | France . |
| 0060174 | 2/1982 | France . |

OTHER PUBLICATIONS

Kobayashi, Yoshio et al., "Bandpass Filter Using TM010 Dielectric Rod Resonators", 1978 IEEE MTT-S, Int'l. Microwave Symposium Dig., Jun. 27-29, 1978, pp. 233-235.

*Primary Examiner*—Eugene R. LaRoche
*Assistant Examiner*—Benny T. Lee
*Attorney, Agent, or Firm*—Cushman, Darby & Cushman

[57] ABSTRACT

A filter comprising a metal case having a metal base and a lid forming a guide of any section but under cut-off, that is to say which does not allow guided propagation. Cylindrical dielectric resonators are in contact with the metal securing base and the resonators resonate then in the TM010 mode. For frequency tuning of the filter, the distance between the bottom of the lid and the ends of the dielectric resonators supported by the base is variable. The invention applies more especially to tuneable band-pass filters.

7 Claims, 5 Drawing Figures

TUNEABLE ULTRA-HIGH FREQUENCY FILTER WITH MODE TM010 DIELECTRIC RESONATORS

BACKGROUND OF THE INVENTION

1. Field of the Invention

The invention relates to the field of tuneable ultra-high frequency filters and relates more particularly to a dielectric resonator filter of this type in which the resonators resonate in mode TM010.

2. Description of the Prior Art

Recent work in the field of dielectric materials has led to the use of such materials for forming dielectric resonators, having a sufficiently high dielectric constant with acceptable temperature coefficients. Most of the filters formed with these dielectric resonators use resonators having a cylindrical form, (rather than a parallelepipedic or spherical form), which have a better Q factor, are more readily machinable and have a field of use towards the "low" frequencies of the ultra-high frequency range (less than 10 GHz).

This technique has led to considerable improvements in ultra-high frequency filters not only from the point of view of their size but also from the point of view of their performance and price. In fact, if we compare dielectric resonator filters with the different rod, iris or evanescent mode types of filters used previously, it can be seen that:

- the Q factor of dielectric resonator filters is slightly less than that of rod or iris filters and very much higher than that of the evanescent mode filters,
- dielectric resonator filters take up less space and are lower in weight;
- the cost of dielectric resonator filters is substantially equal to that of evanescent mode filters and very much less than those of the filters of the two other types.

Tuneable dielectric resonator ultra-high frequency filters, developed up to present, include however a number of drawbacks; first of all, there exists in these filters parasitic modes which may disturb the frequency response of the filters. Moreover, it is difficult to obtain a band width which is variable over a wide range with a filter of a given size. Finally, to obtain tuneability of the filter over a wide band width, tuning systems are provided for varying the tuning frequency of the resonators. These systems generally comprise dielectric rods associated with the resonators, properly speaking, whose penetration is adjustable. These elements provide tuning but they may lower the Q factor obtained when the resonator is alone. Furthermore, they present machining and adjustment problems. Up to present, these filters always used selected modes TE01δ or TM01δ which have good unloaded Q factors. However, as pointed out above, these coefficients decrease in the complete system, with its tuning means. Contrary to the generally held idea, these modes are not the only ones which may be used in dielectric resonators for forming filters with acceptable characteristics.

SUMMARY OF THE INVENTION

The invention in fact provides a tuneable ultra-high frequency filter, with dielectric resonators, operating in the TM010 resonance mode.

The invention provides then a tuneable ultra-high frequency filter with dielectric resonators, comprising:

- a metal case having a longitudinal axis and comprising a base and a lid having a bottom, opposite the base, and forming a plane, the dimensions of this case defining a so called below cut-off ultra-high frequency wave guide,
- a succession of cylindrical dielectric resonators disposed inside the case, aligned along its longitudinal axis, having one of their ends in contact with the metal base and their other ends at an adjustable distance from the bottom of the lid for providing frequency tuning of the filter,
- input and output coupling means for applying the ultra-high frequency signal to one end of the case and supplying the signal to the other end of the case,
- the electromagnetic field resulting from the signal applied being located in and in the vicinity of the dielectric resonators resonating in the TM010 mode.

BRIEF DESCRIPTION OF THE DRAWINGS

The invention will be better understood and other characteristics will appear from the following description with reference to the accompanying Figures.

DESCRIPTION OF THE PREFERRED EMBODIMENTS

The sub assemblies forming part of given ultra-high frequency equipment must be of low price while having high performance. The TM010 mode dielectric resonators, integrated for providing a filtering function, allow a gain to be obtained with respect to evanescent guided structure filters, coaxial filters (comb filter or interdigitated filters) and with respect to filters with dielectric resonators in TE01δ and TM01δ modes. The unloaded Q factor of a dielectric resonator in the TM010 mode varies from a Q=5000 at 2 GHz to a Q=2800 at 6 GHz; these values are sufficient for forming wide band or narrow band filters, or selective filters with a variable tuning frequency. Such filters have couplings of the coaxial-coaxial, guide-guide or guide-coaxial type provided that the tuning means which are associated therewith do not adversely affect these Q factors. Now, dielectric resonators in the TM010 mode may be used very simply and may be associated with different but always simple tuning means which do not introduce any disturbance into the resonance mode. Moreover, there is no need for supports for the dielectric resonators.

Figure 1:
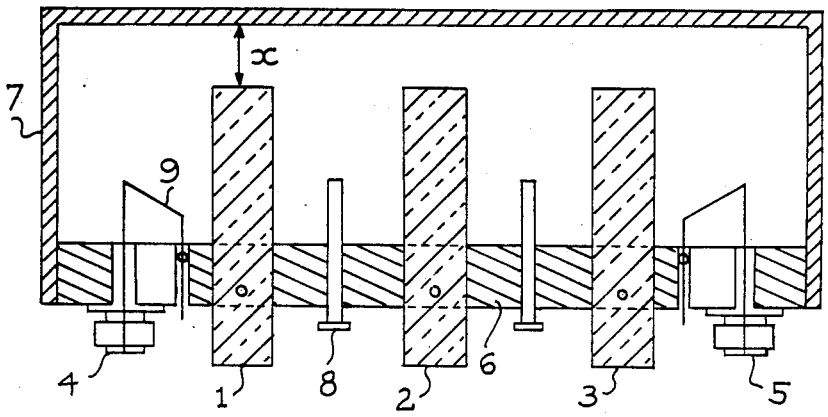
FIG. 1 is the diagram of a longitudinal section of a first embodiment of the ultra-high frequency filter in accordance with the invention.

FIG. 1 shows a first embodiment of the ultra-high frequency of the invention in longitudinal section, this filter having a band-pass function. This filter is formed by three coupled dielectric resonators, 1,2,3, cylindrical in shape, the first and last of these resonators being respectively coupled to input 4 and output 5 means. To operate in a TM010 resonance mode, these resonators are in contact with the metal base 6 to which they are fixed. In this first embodiment, holes are provided in the base, the dielectric resonators being adapted for sliding in these holes. These holes may be lined with a thin dielectric layer, for example polytetrafluorethylene (Teflon, to give it its commercial name) from 2 to $7/100^{th}$ mm in thickness so as to avoid damage to the surfaces during sliding of the resonator.

A lid 7 forms with the securing base 6 a metal screening closure forming a guide, which may have any section, for example rectangular, circular or re-entrant. To reduce ultra-high frequency leaks as much as possible, the part of the resonator external to the guide may be covered with a coating of silver paint or a bonding agent. The bottom of the lid is at a relatively small distance x from the ends of resonators 1, 2 and 3, this distance being adjustable by causing the dielectric resonators 1, 2 and 3 to penetrate inside the guide. The resonators may be locked when the desired tuned frequency is obtained. The dimensions of the case are such that the guide thus formed has a cut-off frequency higher than the frequency at which the filter is used. Thus, under conditions of use, the guide, which does not allow guided propagation, is called "below cut-off". The filtering function of this filter is obtained by locating the electromagnetic field in the vicinity of the dielectric resonators in a TM010 mode. Coupling between successive resonators, which determines the passband of the filter is obtained by an adequate spacing between two successive resonators in the guide, and this coupling may be adjusted by metal screws, such as 8, for adjusting the coupling susceptance between adjacent resonators. The input and the output in the guide are formed by coaxial plugs, the cylindrical outer end piece being fixed to the securing base and the internal conductor passing through this securing base to form inside the guide an adjustable loop 9 coupled with the magnetic field of each endmost resonator. Adjustable loop 9 may be adjusted by varying the length of the loop wire. Tuning of this filter to the minimum frequency of the tuning frequency band is provided when the resonators are in contact with the bottom of the lid i.e. $x=0$.

Figure 2:
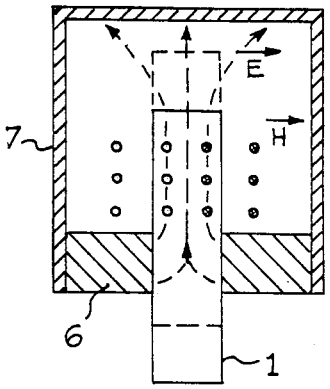
FIG. 2 is a diagram of a cross-section of the filter shown in FIG. 1, at the level of a dielectric resonator.

FIG. 2 shows the ultra-high frequency filter of FIG. 1 in cross-section at the level of the dielectric resonator 1. The field lines have been shown in this Figure. As mentioned above, the electric field is located inside and in the vicinity of the dielectric resonators. The magnetic field lines, orthogonal to the electric field lines, form circles whose centers are on the axis of the resonator, inside and outside the resonator.

Figure 3:
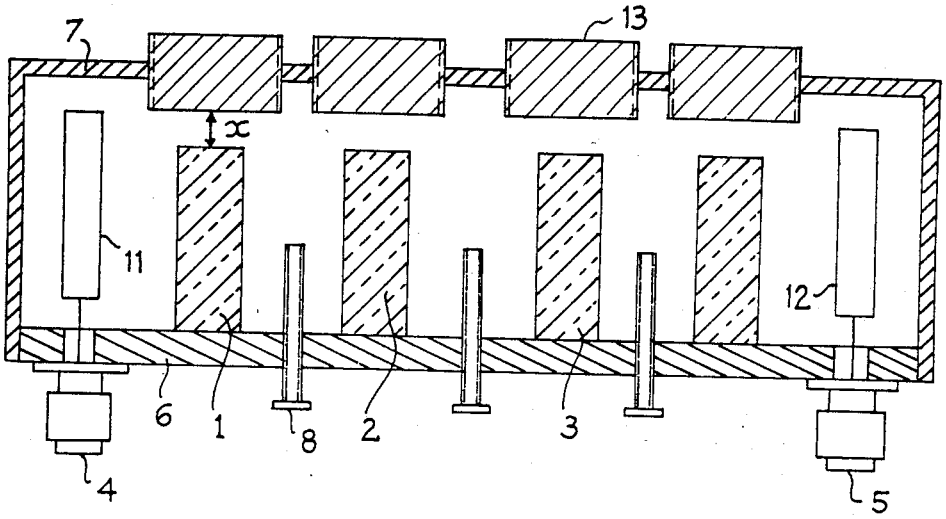
FIG. 3 is the diagram in longitudinal section of a second embodiment of the ultra-high frequency filter in accordance with the invention.

FIG. 3 shows a second embodiment of the ultra-high frequency filter of the invention. This filter also has a bandpass function. In this Figure, the same elements have been shown by the same references. In this embodiment, resonators 1, 2, 3 . . . are placed on the fixing base 6 to which they are permanently fixed. Lid 7 defines, with the securing base 6, a case forming a below cut-off wave guide, rectangular in the example shown. In this embodiment, as in the preceding one, accesses 4 and 5 are provided by coaxial plugs, coupling between these coaxial plugs and the endmost resonators being provided by antennae, respectively 11 and 12. As with adjustable loop 9, antennas 11 and 12 may be adjusted by varying their positions inside the case with adjusting means, e.g. screws. As in the preceding case, metal adjusting screws such as 8 allow the coupling between adjacent resonators to be adjusted. The bottom of lid 7 is provided with metal screws 13 centered on the same axis as the cylindrical dielectric resonators, penetration of these metal screws 13 into the guide being adjustable. Thus, the distance x between the end of the resonators and the plane formed by the bottom of lid 7 and metal screws such as 13 is adjustable, which allows the tuning frequency of the filter to be adjusted.

Figure 4:
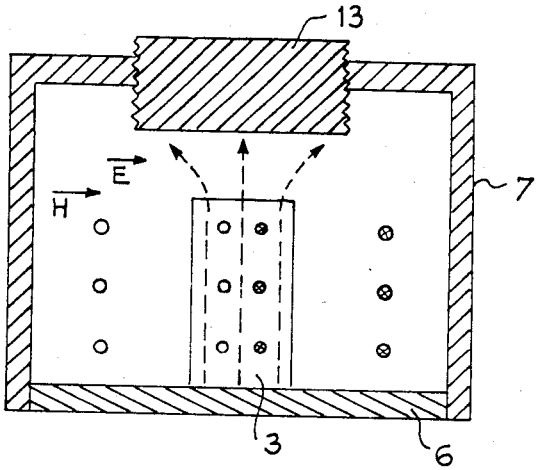
FIG. 4 is a cross-section of the filter shown in FIG. 3, at the level of a dielectric resonator.

FIG. 4 shows a cross section of the filter shown in FIG. 3 through a plane containing the axis of the dielectric resonator 3. The electric field lines and the magnetic field lines have also been shown in this Figure.

Figure 5:
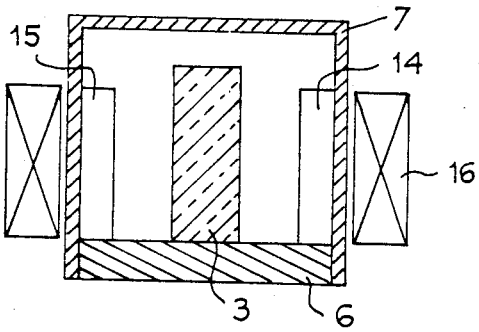
FIG. 5 is the diagram of a cross-section of another embodiment of the ultra-high frequency filter shown in FIG. 3.

In a third embodiment, a cross section of which is shown in FIG. 5, tuning of the central frequency of the filter is no longer provided by mechanical tuning such as the variable penetration of the dielectric resonators in the embodiment shown in FIG. 1 or the variable penetration of the metal adjusting screws such as 13 in the embodiment shown in FIG. 3, but is an electric tuning. The longitudinal section of this embodiment is similar to that shown in FIG. 3 and the diagram thereof is the same except insofar as the metal screws provided in the plane formed by the bottom of lid 7, which screws have been omitted. In this embodiment, as shown in FIG. 5, ferrite materials 14 and 15 are disposed on the lateral walls of the guide, on each side of the dielectric resonators. In this third embodiment, tuning of the filter is obtained by applying a variable magnetic field to the ferrite materials by means of a coil 16. Thus, the permeability of the environmental medium is made variable.

In one embodiment of the filter in accordance with the invention, the ultra-high frequency resonators are formed from zirconium titanate $ZrTiO_4$ to which tin Sn has been added, so as to improve the temperature coefficient. The guide is a square section guide, with sides of length $L=38$ mm; the diameter of the dielectric resonators has been chosen equal to $D=9.9$ mm; the permittivity of the material $\epsilon_r$ is equal to 36 and the lowest frequency obtained is on the order of 2 GHz. In this embodiment, the first parasitic response is rejected at about 3.4 to 3.7 GHz. As mentioned before, the frequency tuning is obtained by varying the effective length of the resonator inside the guide and this frequency may vary between 2 and 2.5 GHz, for example.

With this structure, all types of filters may be formed: bandpass filters, narrow B band filters, for example B varying from 10 MHz to 2 GHz of central frequency, as well as wide band bandpass filters for example B varying from 200 MHz to 2 GHz, the band width being determined, as mentioned above, by the coupling conditions between adjacent resonators. This structure also allows band cut-off filters to be formed. In this case, coupling of the resonators with an electric field provided longitudinally inside the guide is provided by the ends of the resonators.

In addition, the input and output couplings may be provided by a guide, the ends of the guide forming the enclosure of the filter being open so as to provide the connection. The input and the output may be coupled differently, one by the guide, the other by coaxial connection.

The guide may have any form such as an in-line guide, a U guide or a guide having a shape of a ring. The U arrangment allows, for example, feed-back coupling to be provided between non adjacent resonators for modulating the response of the filter. It is also possible to associate several filters together, for example in parallel, coupled to a common access in the form of a guide for forming a diplexer or multiplexer.

Finally, the embodiment given with a central frequency of the order of 2 GHz is in no way limiting and it is possible to form filters having higher central frequencies, for example 7 GHz. The limits are set by a decrease of the quality factor with an increase in frequency.

As mentioned above, the main advantage of the ultra-high frequency filter in accordance with the invention is the simplicity of its structure. Furthermore, as mentioned above, because of the mode itself, there is no close parasitic mode in the response of the filter.

We claim:

1. A tuneable ulta-high frequency filter operating in the TM010 mode, comprising:

a rectangular metal case having a base, a lid and a longitudinal axis parallel to said base, said case being and dimensioned to form a below cut-off ultra-high frequency waveguide;

input means, connected to said case, adapted for receiving an ultra-high frequency signal;

output means, connected to said case, for providing an output signal;

a succession of cylindrical, dielectric resonators disposed inside said case in a line parallel to said longitudinal axis, each said resonator having a resonant portion touching said base and an end which is at an adjustable distance from said lid; and means for adjusting said adjustable distance whereby frequency tuning of said filter may be accomplished and an electromagnetic field in the vicinity of said resonators resonates in the TM010 mode.

2. A filter according to claim 1 wherein said filter is a bandpass filter, and wherein said resonators are movable in a direction orthogonal to said base to cause the length of each said resonant portion within said case to be adjustable, said length being a maximum when said resonator end is in contact with said lid.

3. A filter according to claim 1 wherein said filter is bandpass filter, and wherein said resonators are fixed to said base, and wherein said means for adjusting includes said lid having a plurality of adjusting screws, each screw being mounted in proximity to said end of at least one adjacent resonator whereby said adjustable distance is adjusted by screwing said screw.

4. A filter according to claim 1 wherein said input and output means each include a coupling loop having a wire of adjustable length disposed inside of said case.

5. A filter according to claim 1 wherein said input and output means each include an antenna whose position inside said case is adjustable.

6. A filter according to claim 1 wherein said base includes a plurality of coupling adjustment screws each one of which is disposed between adjacent ones of said resonators and is moveable in a direction orthogonal to said base to cause coupling between adjacent resonators to be adjustable whereby said filter may be tuned.

7. An electrically tunable ultra-high frequency filter operating in the TM010 mode, comprising:

a rectangular case including a base, a lid, two sidewalls with ferrite materials disposed thereon, a longitudinal axis parallel to said base and said sidewall, said case dimensioned to form a below cut-off ultra-high frequency waveguide;

input means, connected to said case, for providing an input signal;

output means, connected to said case, for providing an output signal;

a succession of cylindrical dielectric resonators disposed inside said case in a line parallel to said longitudinal axis, each said resonator having a resonant portion with a first end touching said base and a second end at a fixed distance from said lid; and coil means, disposed outside of said case, for supplying a variable magnetic field to said ferrite materials to cause said filter to be electrically tuned.

* * * * *